US011499343B2

(12) United States Patent
Jung

(10) Patent No.: US 11,499,343 B2
(45) Date of Patent: Nov. 15, 2022

(54) DOOR LOCK APPARATUS

(71) Applicant: ZIGBANG CO., LTD., Seoul (KR)

(72) Inventor: Jae Woong Jung, Seoul (KR)

(73) Assignee: ZIGBANG CO., LTD., Seoul (KR)

( * ) Notice: Subject to any disclaimer, the term of this patent is extended or adjusted under 35 U.S.C. 154(b) by 341 days.

(21) Appl. No.: 16/868,791

(22) Filed: May 7, 2020

(65) Prior Publication Data

US 2020/0354989 A1 Nov. 12, 2020

(30) Foreign Application Priority Data

May 7, 2019 (KR) ..... 10-2019-0052912

(51) Int. Cl.
*E05B 47/00* (2006.01)

(52) U.S. Cl.
CPC .... *E05B 47/0012* (2013.01); *E05B 2047/002* (2013.01); *E05B 2047/003* (2013.01)

(58) Field of Classification Search
CPC ..... E05B 47/0012; E05B 2047/002; E05B 2047/003; E05B 2047/0031; E05B 2047/0086; E05B 17/0041
USPC ..... 340/5.7, 5.3; 292/336.3
See application file for complete search history.

(56) References Cited

U.S. PATENT DOCUMENTS 4,438,962 A 3/1984 Soloviff et al.
6,471,257 B1 10/2002 Lu et al.
6,471,258 B1 10/2002 Bombuy Perich
7,516,633 B1 * 4/2009 Chang ..... E05B 13/101 70/279.1
7,963,134 B2 * 6/2011 Rafferty ..... E05B 13/00 192/84.92
8,365,561 B2 * 2/2013 Chang ..... E05B 47/02 70/279.1
8,490,445 B2 * 7/2013 Chiou ..... E05B 47/0012 70/279.1
8,555,684 B1 * 10/2013 Chen ..... E05B 47/0012 292/144
9,464,458 B2 * 10/2016 Huang ..... E05B 1/003
9,500,005 B2 * 11/2016 Chen ..... E05B 47/0012
9,790,711 B2 * 10/2017 McKibben ..... E05B 47/0012
10,487,544 B2 * 11/2019 Ainley ..... G01D 5/12
(Continued)

FOREIGN PATENT DOCUMENTS

KR 20-0363389 Y1 10/2004
WO WO 2016/194304 A1 12/2016

OTHER PUBLICATIONS

Examination Report dated Feb. 5, 2021 from Australian Intellectual Property Office in a counterpart Australian Patent Application No. 2020203032.

*Primary Examiner* — Nam V Nguyen
(74) *Attorney, Agent, or Firm* — The PL Law Group, PLLC

(57) ABSTRACT

A door lock apparatus according to an embodiment of the present invention is mounted in a door and moves a deadbolt to a locked position or a released position as a motor is driven. The door lock apparatus may include a main gear rotated by the motor, a damping clutch part engaged and rotated by rotation of the main gear, a shaft which is engaged and rotated by rotation of the damping clutch part and moves the deadbolt as the shaft is rotated, and a knob which is manually operable by a user and is connected to the shaft. An emergency rotation operation of the shaft may be enabled by disengaging the main gear and the damping clutch part through the knob.

11 Claims, 7 Drawing Sheets

(56) References Cited

U.S. PATENT DOCUMENTS

| | | | | |
|---|---|---|---|---|
| 2003/0167693 | A1* | 9/2003 | Mainini | E05F 15/63<br>49/281 |
| 2009/0211320 | A1* | 8/2009 | Wu | E05B 47/0012<br>70/277 |
| 2020/0354989 | A1* | 11/2020 | Jung | E05B 47/0012 |

* cited by examiner

DOOR LOCK APPARATUS

CROSS REFERENCE TO RELATED APPLICATIONS AND CLAIM OF PRIORITY

This application claims the benefit under 35 USC § 119(a) of Korean Patent Application No. 10-2019-0052912, filed on May 7, 2019, in the Korean Intellectual Property Office, the entire disclosure of which is incorporated herein by reference for all purposes.

BACKGROUND

1. Field

The following description relates to a door lock apparatus.

2. Description of Related Art

Electronic lock apparatuses widely used in recent years may be configured to be operable by input of a preset password through a keypad provided on the outside of a door or by use of a safety key embedded with a semiconductor chip. Accordingly, the door lock apparatuses may include a motor operated to move a deadbolt in response to an external user input (password input, safety key, etc.), a shaft connected to the deadbolt, and components for power transmission from the motor to the shaft. Movement of a deadbolt to a locked or released position according to a shaft rotation is disclosed in Korean Utility Model Publication No. 20-0363389.

In the case of a conventional door lock apparatus, there are cases where internal components are broken during the movement of a deadbolt to a locked position or a released position and, in turn, jamming occurs in a connecting component between a motor and a shaft, resulting in failure of operation of the door lock apparatus. To fix such problems, the door lock apparatus should be dismantled and internal components should be replaced to operate a door lock.

In addition, there is a case where the deadbolt is not aligned with a striker on a door frame or is not horizontally level due to damage to an installation structure of a door itself. In this case, the motor continues to operate even when the deadbolt does not completely move to a locked position and is restricted from movement on the door frame, and consequently, a load is imposed on the motor, leading to motor failure.

Moreover, when a user arbitrarily rotates the shaft due to discharge of a power source, such as a battery for operating the motor, a motor rotating shaft is manually rotated by the user, which also causes a load to be imposed on the motor, resulting in damage and motor failure.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention are to provide a door lock apparatus capable of easily moving a deadbolt even when internal components, such as gears for deadbolt movement, are damaged and rotation operation of a damping clutch is difficult.

In addition, embodiments of the present invention are to provide a door lock apparatus capable of preventing a load from being imposed on a motor by disengaging a damping clutch part and a main gear when movement of a deadbolt is restricted by a door frame or the like during the movement of the deadbolt to a locked position.

Moreover, embodiments of the present invention are to provide a door lock apparatus that allows easy operation of a deadbolt through a knob even when a motor is not operated due to battery discharge.

In one general aspect, there is provided a door lock apparatus, which is mounted in a door and moves a deadbolt to a locked position or a released position as a motor is driven, including a main gear rotated by the motor, a damping clutch part engaged and rotated by rotation of the main gear, a shaft which is engaged and rotated by rotation of the damping clutch part and moves the deadbolt as the shaft is rotated, and a knob which is manually operable by a user and is connected to the shaft, wherein an emergency rotation operation of the shaft is enabled by disengaging the main gear and the damping clutch part through the knob.

When the user presses the knob along an axial direction of the shaft, the shaft may be moved along the axial direction and the damping clutch part may be disengaged from the main gear.

The shaft may include a stepped portion that engages the damping clutch part along the axial direction of the shaft and the damping clutch part may be capable of being lifted to an opposite side of the main gear by the stepped portion.

The main gear may include a plurality of restricting grooves spaced apart at a predetermined angle from each other along a circumferential direction, the damping clutch unit may include a plurality of restricting projections each of which is insertable into each corresponding constraining groove, and the damping clutch part may be disengaged from the main gear as the plurality of restricting projections are dislodged from the plurality of restricting grooves.

The door lock apparatus may further include an elastic member which elastically supports the damping clutch part toward the main gear.

The shaft may include a clutch engaging portion protruding in a radial direction and the damping clutch part may include a flow groove which is formed in a shape of a circular arc of a predetermined angle and in which the clutch engaging portion is positioned.

When the user rotates the knob, the clutch engaging portion may be rotated about a central axis of the shaft within the flow groove.

The shaft and the knob may be elastically supported at an interval of 90 degrees in a rotation process.

In another general aspect, there is provided a door lock apparatus, which is mounted in a door and moves a deadbolt to a locked position or a released position as a motor is driven, including a main gear rotated by the motor, a damping clutch part engaged and rotated by rotation of the main gear, and a shaft which is engaged and rotated by rotation of the damping clutch part and moves the deadbolt as the shaft is rotated, wherein when the motor is continuously operated in a state in which rotation of the shaft is restricted, the main gear is disengaged from the damping clutch part and is independently rotated.

The main gear may include a plurality of restricting grooves spaced apart at a predetermined angle from each other along a circumferential direction, the damping clutch unit may include a plurality of restricting projections each of which is insertable into each corresponding constraining groove, and the main gear may be disengaged from the damping clutch part as the plurality of restricting projections are dislodged from the plurality of restricting grooves.

The door lock apparatus may further include an elastic member which elastically supports the damping clutch part toward the main gear.

The shaft may include a clutch engaging portion protruding in a radial direction and the damping clutch part may include a flow groove which is formed in a shape of a circular arc of a predetermined angle and in which the clutch engaging portion is positioned.

The door lock apparatus may further include a knob which is manually operable by a user and is connected to the shaft, wherein when the user rotates the knob, the clutch engaging portion is rotated about a central axis of the shaft within the flow groove.

The shaft may be elastically supported at an interval of 90 degrees in a rotation process.

Other features and aspects will be apparent from the following detailed description, the drawings, and the claims.

Figure 1:
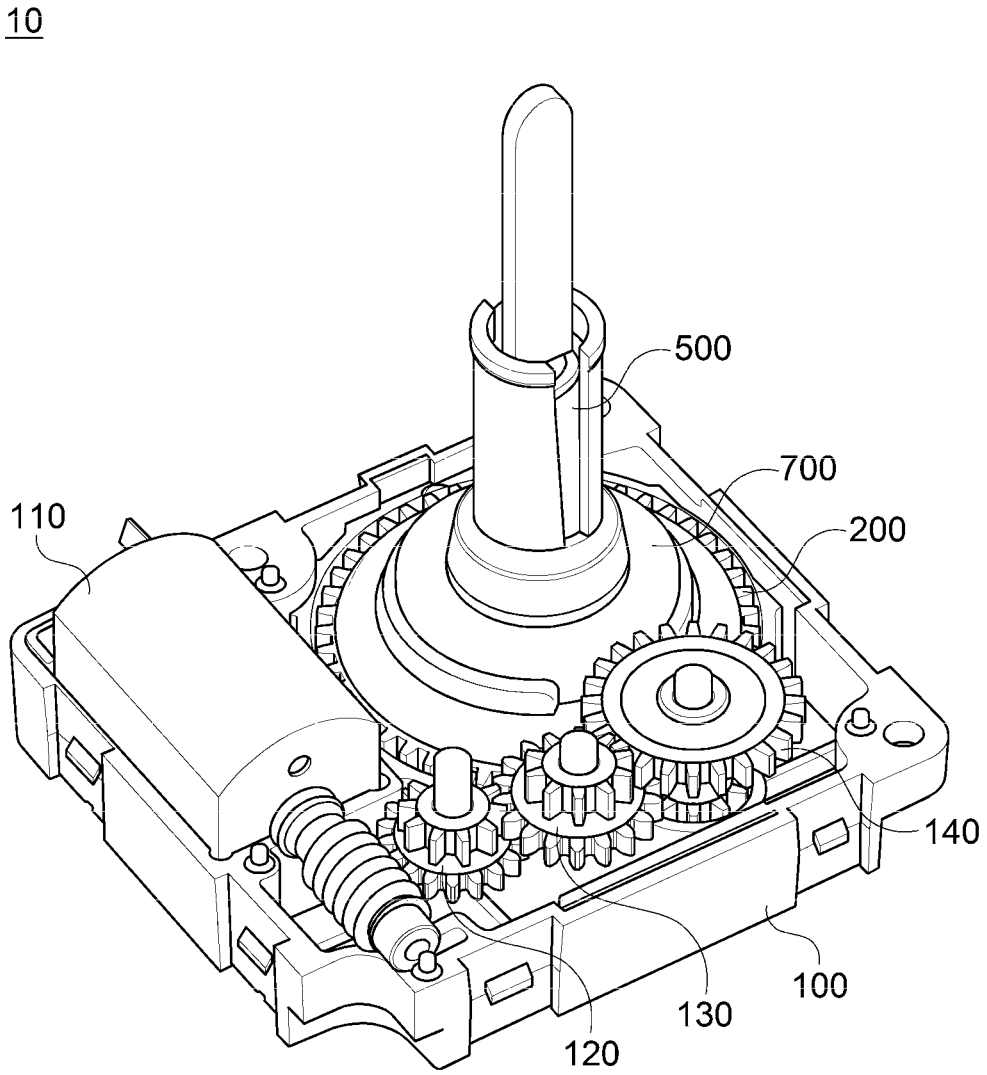
FIG. 1 is a perspective view showing an internal structure of a door lock apparatus according to one embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Hereinafter, detailed embodiments of the present invention will be described with reference to the accompanying drawings. The following detailed description is provided for a more comprehensive understanding of methods, devices and/or systems described in this specification. However, the methods, devices, and/or systems are only examples, and the present invention is not limited thereto.

In the description of the present invention, detailed descriptions of related well-known functions that are determined to unnecessarily obscure the gist of the present invention will be omitted. Some terms described below are defined in consideration of functions in the present invention, and meanings thereof may vary depending on, for example, a user or operator's intention or custom. Therefore, the meanings of terms should be interpreted based on the scope throughout this specification.

The technical spirit of the present invention is determined by the claims, and the following examples are merely a means for efficiently explaining the technical spirit of the present invention to those skilled in the art to which the present invention pertains.

Figure 2:
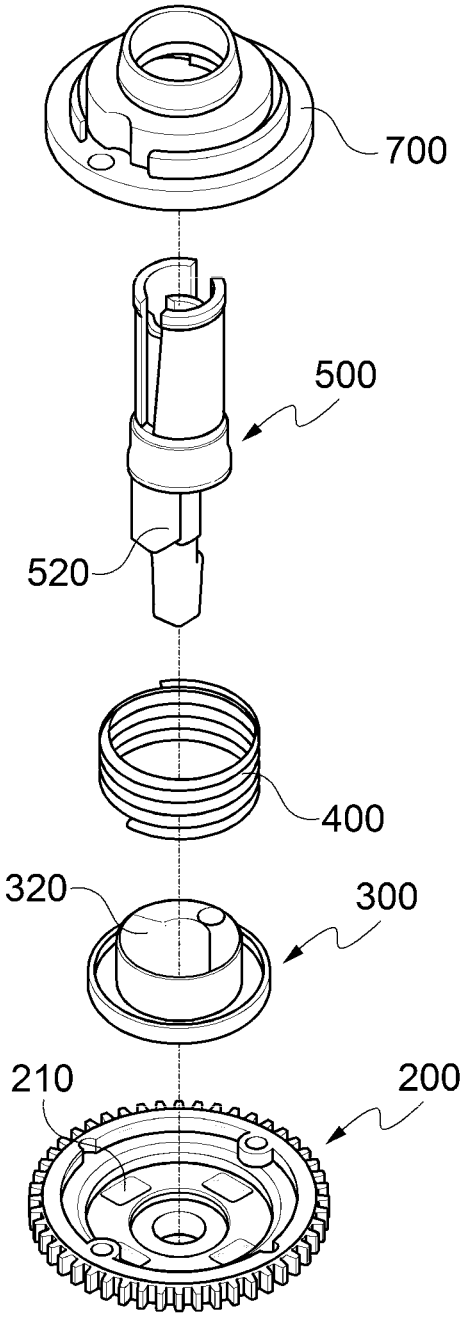
FIG. 2 is a partially exploded perspective view of a door lock apparatus according to an embodiment of the present invention.

FIG. 1 is a view showing internal structure of a door lock apparatus 10 according to an embodiment of the present invention, and FIG. 2 is a partially exploded perspective view showing the door lock apparatus 10 according to one embodiment of the present invention.

Referring to FIGS. 1 and 2, the door lock apparatus 10 according to one embodiment of the present invention may include a housing 100, a motor 110, a first gear 120, a second gear 130, a third gear 140, and a fourth gear 150. In this case, as the motor 110, the first gear 120, the second gear 130, the third gear 140, and the fourth gear 150 are continuously engaged with each other, the motor 110 operates, which allows each component to rotate in a predetermined direction. In addition, the above-described housing 100 may accommodate the motor 110, the first gear 120, the second gear 130, the third gear 140, and the fourth gear 150 and may be mounted on a door. The door lock apparatus 10 mounted on a door according to one embodiment of the present invention may move a deadbolt (shown in FIGS. 5A and 5B) to a locked or released position as the motor 110 inside the door lock apparatus 10 is driven.

In addition, the door lock apparatus 10 according to one embodiment of the present invention may include a main gear 200 which is engaged with the fourth gear 150 and rotated by the above-described motor 110, a damping clutch part 300 engaged and rotated by the rotation of the main gear 200, a shaft 500 which moves the deadbolt 20 as it rotates, and a knob 600 which is manually operable by a user and is directly connected to the shaft 500. In this case, the above described main gear 200, the damping clutch part 300, and a part of the shaft 500 may be located in the housing 100.

Specifically, the above-described main gear 200, the damping clutch part 300 and the shaft 500 may be arranged coaxially in a row, and when the main gear 200 is rotated by the motor 110, the damping clutch part 300 and the shaft 500 may be rotated together.

In addition, the door lock apparatus 10 according to one embodiment of the present invention may further include an elastic member 400 which elastically supports the damping clutch part 300 toward the main gear 300 and a clutch cover 700 which is disposed coaxially with the elastic member 400 and the shaft 500, and the elastic member 400 may elastically support the damping clutch part 300 at one side toward the main gear 200 while being supported at the other side by the clutch cover 700.

In addition, the main gear 200 may include a plurality of restricting grooves 210 spaced apart from each other at a predetermined angle along a circumferential direction, and the damping clutch unit 300 may include a plurality of restricting projections (shown in FIG. 3), each of which is inserted into each corresponding constraining groove 210. In this case, the plurality of restricting grooves 210 may be formed to be embedded to a predetermined depth from an outer surface at a side of the damping clutch part 300 of the main gear 200, and the plurality of restricting projections 310 may be formed to protrude outward to a predetermined height from an outer surface at the main gear 200 of the damping clutch part 300.

In addition, there may be provided four restricting grooves 210 and the restricting grooves 210 may be spaced apart from each other at an angle of 90 degrees. There may be four restricting projections 310 corresponding to the restricting grooves 210 and the restricting projections 310 may be spaced apart from each other at an angle of 90 degrees. Meanwhile, the plurality of restricting grooves 210 and the plurality of restricting projections 310 may be disposed to have the same radius.

As described above, each of the plurality of restricting projections 310 may be inserted into each of the plurality of restricting grooves 210, and the above-described damping clutch part 300 and the main gear 200 may be rotationally restricted relative to each other through the plurality of restricting grooves 210 and the plurality of restricting projections 310. Meanwhile, an embodiment in which the main gear 200 and the damping clutch part 300 are disengaged from each other and rotated independently of each other will be described below.

On the other hand, when the above-described shaft 500 rotates, the deadbolt 20 connected to an axial end of the shaft 500 may may be moved to a locked position or a released position, and when the deadbolt 20 is moved to a released position, the deadbolt 20 may be inserted into a striker (not shown) on a door frame (not shown), thereby locking a door. In this case, the position movement of the deadbolt 20 according to the rotation of the shaft 500 pertains to the prior art described above, and hence detailed description thereof will be omitted.

Thus, the user may move the deadbolt 20 to a locked position or a released position through rotation of the motor 110 and may open or close the door. For example, the user may drive the motor 110 described above by inputting an authentication signal, such as a password, fingerprint authentication, terminal authentication using wireless communication, through an outdoor authentication unit (not shown). In addition, the motor 110 may be driven by operating an open button (not shown) formed on an indoor unit in a room. That is, the user may move the deadbolt to a released position through driving of the motor 110 both indoors and outdoors.

Additionally, when a battery or the like for driving the motor 110 is discharged and it is difficult to operate the motor 110, the user may move the deadbolt 20 by operating the knob 600 directly connected to the shaft 500.

Figure 3:
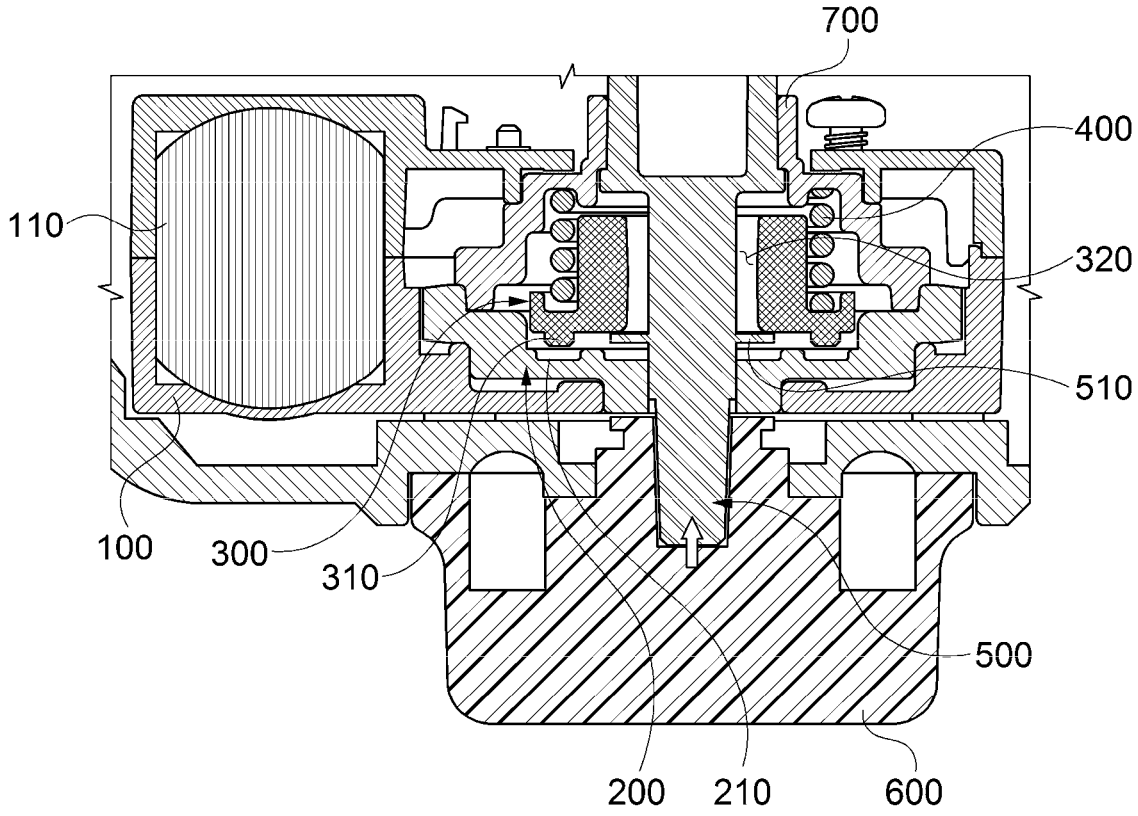
FIG. 3 is a cross-sectional view showing a state in which a damping clutch part and a main gear are disengaged from each other through pressing of a knob according to one embodiment of the present invention.

FIG. 3 is a cross-sectional view illustrating a state in which the damping clutch part 300 and the main gear 200 are disengaged from each other through pressing of the knob 600 according to one embodiment of the present invention.

Referring to FIG. 3, the user may perform emergency rotation of the shaft 500 by disengaging the main gear 200 and the damping clutch part 300 through the above-described knob 600. For example, when gear jamming occurs due to damage to a specific component in a connection structure of the motor 110, the first gear 120, the second gear 130, the third gear 140, the fourth gear 150, and the main gear 200, the rotation of the shaft 500 may not be easy due to the constraint relationship between the damping clutch part 300 and the main gear 200 even if the user rotates the shaft 500 through the knob 600.

At this time, the shaft 500 may be moved along an axial direction of the shaft 500 by the user pressing the knob 600 along the axial direction, and the damping clutch part 300 may be disengaged from the main gear 200.

Specifically, the shaft 500 may include a stepped portion 510 that engages the damping clutch portion 300 along the axial direction of the shaft 500, and the damping clutch part 300 may be lifted to an opposite side of the main gear 200 by the stepped portion 510. That is, when the user presses the knob 600 in the axial direction against an elastic force of the elastic member 400 (upward pressing in the drawings), the damping clutch part 300 may be lifted by the stepped portion 510 and thereby disengaged from the main gear 200, and may freely rotate 360 degrees.

Thereafter, the user may be allowed to freely rotate the damping clutch part 300 and the shaft 500 that are disengaged from the main gear 200 through the operation of the knob 600, and even when gear jamming occurs due to damage to one of the components in the connection structure of the motor 110, the first gear 120, the second gear 130, the third gear 140, the fourth gear 150, and the main gear 200, the shaft 500 may be smoothly rotated to move the deadbolt 20 to a released position.

Figure 4:
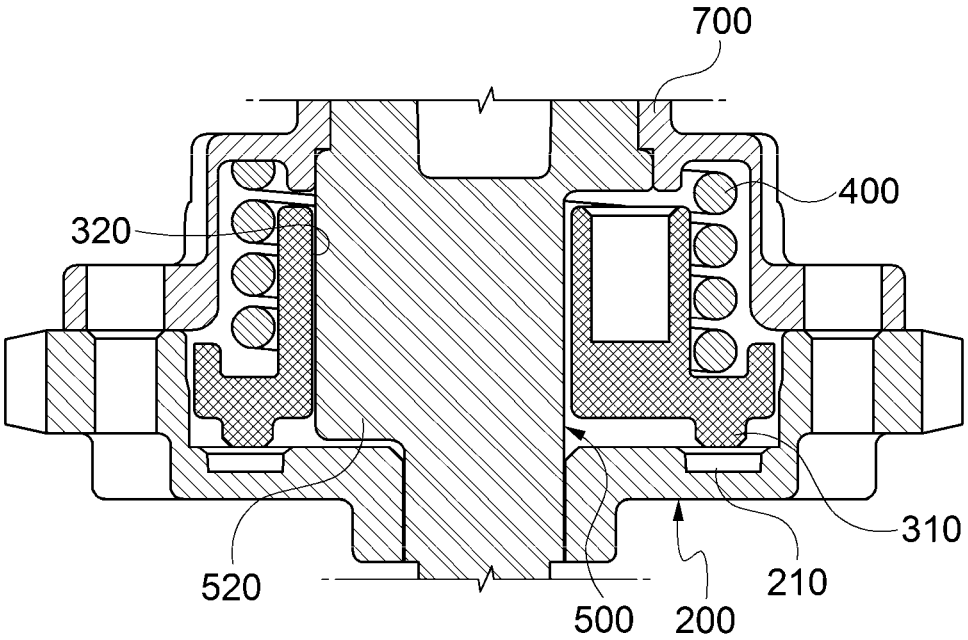
FIG. 4 is a cross-sectional view showing a state in which the damping clutch part and the main gear are disengaged from each other during the operation of a motor according to one embodiment of the present invention.

FIG. 4 is a cross-sectional view illustrating a state in which the damping clutch part 300 and the main gear 200 are disengaged from each other during the operation of the motor 110 according to one embodiment of the present invention.

Referring to FIG. 4, as described above, the damping clutch part 300 may restrict the rotation of the shaft 500 and be elastically supported by the elastic member 400 toward the main gear 200. That is, the main gear 200 and the damping clutch part 300 are rotated together as the motor 110 is operated. If the deadbolt 20 is not completely aligned with the striker on the door frame in the course of moving the deadbolt 20 from a released position to a locked position or when the deadbolt 20 is not level due to damage to an installation structure of the door itself, the deadbolt 20 may be restricted from moving to a released position. In addition, the shaft 500 may also be restricted from rotation.

In this case, the motor 110 continues to operate for a predetermined operating time or within a radius of rotation, and the motor 110 may be continuously operated even while the rotation of the shaft 500 is restricted. Accordingly, a load may be imposed on the motor 110 by the shaft 500 and the damping clutch part 300 which are not rotated, and it may lead to damage and failure of the motor 110.

Therefore, in order to prevent the load on the motor 110 in the above-described situation, the door lock apparatus 10 according to one embodiment of the present invention may include a structure in which, when the movement of the damping clutch part 300 is restricted, only the main gear 200 is independently rotated, thereby preventing a load from being applied to the motor 110.

Specifically, as described above, the damping clutch part 300 may be rotated together with the main gear 200 as the plurality of restricting projections 310 are inserted and engaged in the plurality of restricting grooves 210 on the main gear 200. At this time, each of the plurality of restricting projections 310 may include a round curved surface shape formed on an outer surface, and each of the plurality of restricting grooves 210 may have a tapered or round inner peripheral surface of an end into which each of the restricting projections 310 is inserted. That is, a diameter of an end of the restricting groove 210 at a side of the damping clutch part 300 in an axial direction may be formed larger than a diameter of an end at a side of the knob 600.

Accordingly, when the main gear 200 is continuously rotated in a situation in which the shaft 500 and the damping clutch part 300 are rotationally restricted while the plurality of restricting projections 310 are inserted and engaged in the plurality of restricting grooves 210, each of the plurality of restricting projections 310 may be dislodged from each of the plurality of restricting grooves 210 and the damping clutch part 300 may be lifted while overcoming the elastic support force of the elastic member 400. In this case, the main gear 200 may be independently rotated by being disengaged from the damping clutch part 300, and when the main gear 200 is rotated by an angle of 90 degrees, which is a separation angle of the restricting grooves 210, the plurality of restricting projections 310 may be inserted and engaged again in the plurality of restricting grooves 210.

That is, even when the motor 110 is continuously driven in a state where the rotation of the shaft 500 is restricted because the deadbolt 20 is not fully moved to a released position, the door lock apparatus 10 according to one embodiment of the present invention allows the main gear 200 to be rotated independently of the damping clutch part 300, thereby preventing an excessive rotational force load from being imposed on the motor 110.

On the other hand, the curvature of the round outer surface of each of the above-described restricting projections 310 and the curvature or slope of the round or tapered inner peripheral surface of each of the restricting grooves 210 may be formed to have a size that allows the restricting projections 310 to be dislodged from the restricting grooves 210 while sufficiently overcoming the elastic support force of the elastic member 400 when the main gear 200 is rotated by the motor 110.

Figure 5A:
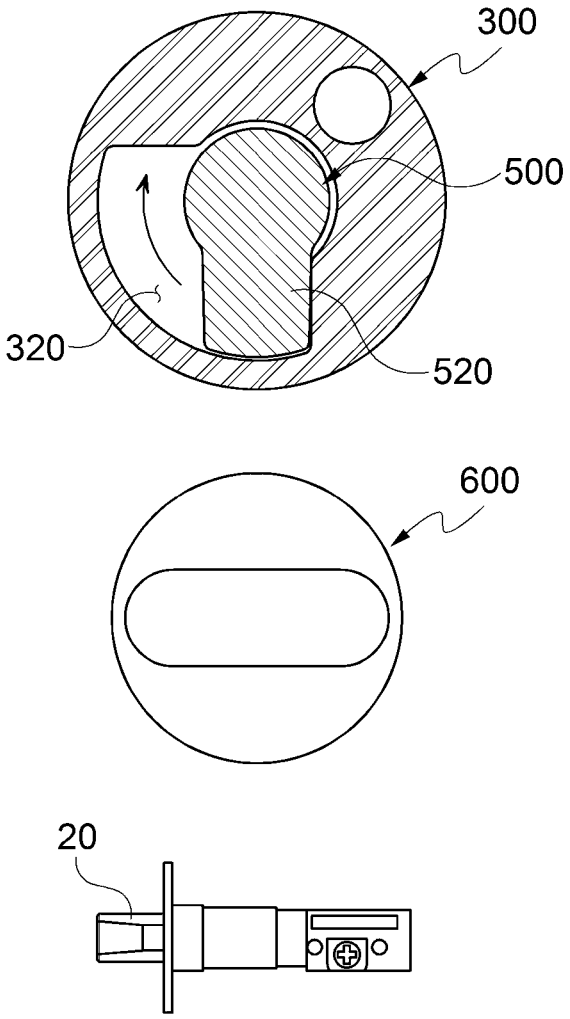
FIG. 5A illustrates diagrams showing positions of each of the knob, the damping clutch part and a shaft when a deadbolt is located in a locked position according to one embodiment of the present invention.
Figure 5B:
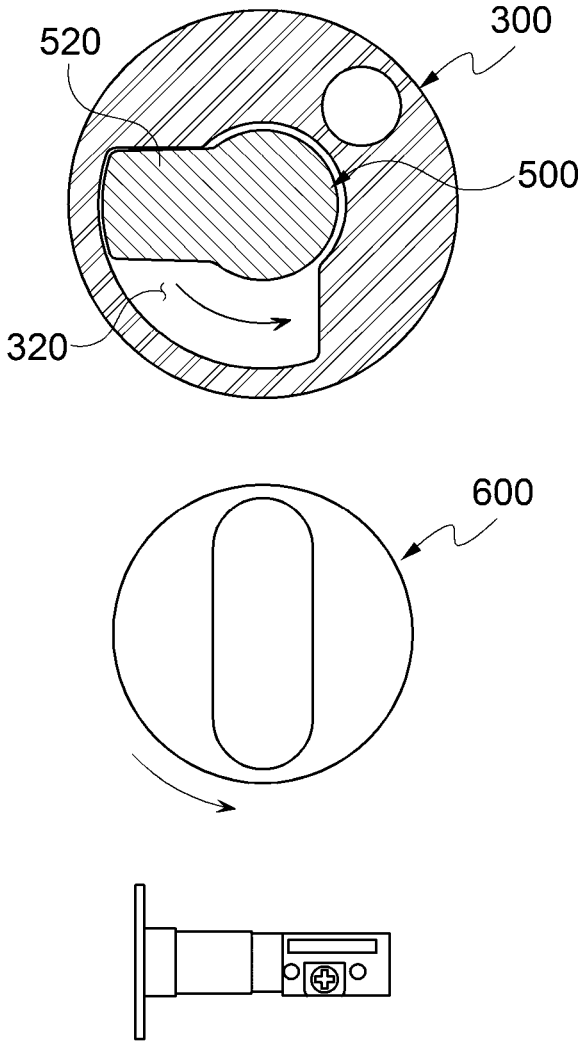
FIG. 5B illustrates diagrams showing positions of each of the knob, the damping clutch part, and the shaft when the deadbolt is located in a released position according to one embodiment of the present invention.

FIG. 5A is a view showing positions of each of the knob 600, the damping clutch part 300 and the shaft 500 when the deadbolt 20 is positioned in a locked position according to one embodiment of the present invention, and FIG. 5B is a view showing positions of each of the knob 600, the damping clutch part 300 and the shaft 500 when the deadbolt 20 is located in a released position according to one embodiment of the present invention.

Referring to FIGS. 5A and 5B, the shaft 500 of the door lock apparatus 10 according to one embodiment of the present invention may be engaged and rotated as the damping clutch part 300 is rotated. Specifically, the shaft 500 may include a clutch engaging portion 530 protruding from an outer circumferential surface in a radial direction, and the damping clutch part 300 may include a flow groove 320 in which the clutch engaging portion 520 is positioned. Accordingly, when the damping clutch part 300 is rotated, the damping clutch part 300 may engage and rotate the shaft 500 through the clutch engaging portion 520 positioned in the flow groove 320. In addition, on the contrary, when the shaft 500 is rotated by the knob 600 or the like, the shaft 500 may rotate the damping clutch part 300 through the clutch engaging portion 520 positioned in the flow groove 320.

On the other hand, when the battery or the like for driving the motor 110 is discharged and hence it is difficult to operate the motor 10 as described above, the user may move the deadbolt 20 by operating the knob 600 directly connected to the shaft 500. However, in the case of a conventional door lock, the main gear 200 and the rotation shaft of the motor 110 are also manually rotated by the user manually rotating the shaft 500 via the knob 600, and damage or failure of the motor 110 may be caused as the rotation shaft of the motor 110 is arbitrarily rotated by force of the user.

For this reason, the damping clutch part 300 of the door lock apparatus 10 according to one embodiment of the present invention may include the flow groove 320 which is formed in the shape of a circular arc of a predetermined angle and in which the clutch engaging portion 520 is positioned. In this case, when the shaft 500 is rotated, the clutch engaging portion 520 may be rotated in a circumferential direction, and as the clutch engaging portion 520 engages a circumferential end of the flow groove 320, the damping clutch part 300 and the shaft 400 may be rotated together. In addition, as the circumferential end of the flow groove 320 engages the clutch engaging portion 520, the damping clutch part 300 and the shaft 500 may be rotated together.

On the other hand, when the driving of the motor 110 is limited due to the above-described battery discharge or the like, the user may manually rotate the knob 600 to rotate the shaft 500. At this time, when the deadbolt 20 is located in a locked position, the clutch engaging portion 520 of the shaft 500 that is engaged and rotated in one direction by the damping clutch part 300 may be positioned one circumferential end in the flow groove 320. When the user operates the knob 600 to position the deadbolt 20 to a released position, the clutch engaging portion 520 may be rotated in another direction with respect to a central axis of the shaft 500 in the flow groove 320. That is, the clutch engaging part 520 may only be rotated within the flow groove 320 and may not engage and rotate the damping clutch part 300 and the main gear 200. Accordingly, it is possible to prevent an arbitrary rotation load from being imposed on the motor 110 when the knob 600 is operated.

Further, as the shaft 500 is rotated by an angle of about 90 degrees, the deadbolt 20 may be moved to a locked position or a released position, wherein the above-described flow groove 320 may be formed to have an angle of greater than 90 degrees such that the clutch engaging portion 520 can be rotated by an angle of about 90 degrees without restriction within the flow groove 320. Preferably, the flow groove 320 may be formed at an angle that allows the formation of an angle of about 90 degrees when the circumferential central axis of the clutch engaging portion 520 with respect to the shaft 500 is positioned at both circumferential ends within the flow groove 320.

Figure 6:
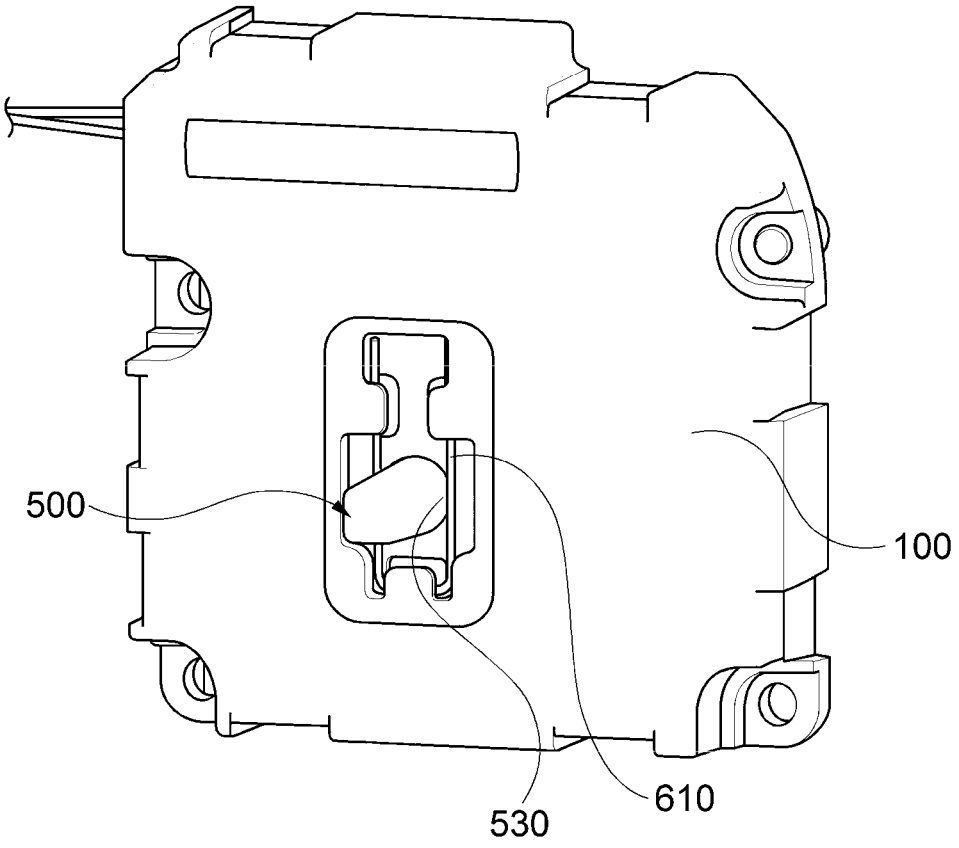
FIG. 6 is a perspective view showing a front side of a housing equipped with the knob in the door lock apparatus according to an embodiment of the present invention.

FIG. 6 is a perspective view showing a front surface of the housing 100 to which the knob 600 is mounted in the door lock apparatus 10 according to one embodiment of the present invention.

Referring to FIG. 6, as described above, the deadbolt 20 may be moved to a locked position or released position as the shaft 400 is rotated at an interval of 90 degrees. In addition, the shaft 50 and the knob 600 may be elastically supported at a rotation angle interval of 90 degrees in the rotation process so that the shaft 500 can be smoothly rotated and supported at an interval of 90 degrees.

Specifically, one end of the shaft 500 to which the knob 600 is coupled may protrude and be exposed to an exterior of the housing 100, and four flat support portions 530 may be formed on an outer circumferential surface of the end of the shaft 500 to which the knob 600 is coupled. That is, the outer circumferential surface of the shaft 500 on which the flat support portions 530 may be formed such that a cross section thereof orthogonal to an axial direction is in a rectangular shape with rounded corners. In this case, the outer circumferential surface of the shaft 500 on which the flat supports 530 are formed may be elastically supported by a pair of linear elastic support portions 610 disposed on an outer surface of the housing 100 and having a predetermined elasticity, and the shaft 500 may be elastically supported at positions of 0 degrees and 90 degrees.

According to the embodiments of the present invention, it is possible to easily move the deadbolt even when the internal components, such as gears for deadbolt movement, are damaged and rotational operation of the damping clutch is difficult.

In addition, according to the embodiments of the present invention, it is possible to prevent a load from being imposed on the motor by disengaging the damping clutch part and the main gear when movement of a deadbolt is restricted by a door frame or the like during the movement of the deadbolt to a locked position.

Further, according to embodiments of the present invention, it is possible to easily the deadbolt through the knob even when the motor is not operated due to battery discharge or the like.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A door lock apparatus which is mounted in a door and moves a deadbolt to a locked position or a released position as a motor is driven, the door lock apparatus comprising:

a main gear rotated by the motor;

a damping clutch part engaged and rotated by rotation of the main gear;

a shaft which is engaged and rotated by rotation of the damping clutch part and moves the deadbolt as the shaft is rotated; and a knob which is manually operable by a user and is connected to the shaft, wherein an emergency rotation operation of the shaft is enabled by disengaging the main gear and the damping clutch part through the knob, wherein when the user presses the knob along an axial direction of the shaft, the shaft is moved along the axial direction and the damping clutch part is disengaged from the main gear, wherein the shaft includes a stepped portion that engages the damping clutch part along the axial direction of the shaft and the damping clutch part is capable of being lifted to an opposite side of the main gear by the stepped portion.

2. The door lock apparatus of claim 1, wherein the main gear includes a plurality of restricting grooves spaced apart at a predetermined angle from each other along a circumferential direction, the damping clutch unit includes a plurality of restricting projections each of which is insertable into each corresponding constraining groove, and the damping clutch part is disengaged from the main gear as the plurality of restricting projections are dislodged from the plurality of restricting grooves.

3. The door lock apparatus of claim 1, further comprising an elastic member which elastically supports the damping clutch part toward the main gear.

4. The door lock apparatus of claim 1, wherein the shaft includes a clutch engaging portion protruding in a radial direction and the damping clutch part includes a flow groove which is formed in a shape of a circular arc of a predetermined angle and in which the clutch engaging portion is positioned.

5. The door lock apparatus of claim 4, wherein when the user rotates the knob, the clutch engaging portion is rotated about a central axis of the shaft within the flow groove.

6. The door lock apparatus of claim 1, wherein the shaft and the knob are elastically supported at an interval of 90 degrees in a rotation process.

7. A door lock apparatus which is mounted in a door and moves a deadbolt to a locked position or a released position as a motor is driven, the door lock apparatus comprising:

a main gear rotated by the motor;

a damping clutch part engaged and rotated by rotation of the main gear; and a shaft which is engaged and rotated by rotation of the damping clutch part and moves the deadbolt as the shaft is rotated, wherein when the motor is continuously operated in a state in which rotation of the shaft is restricted, the main gear is disengaged from the damping clutch part and is independently rotated, wherein the main gear includes a plurality of restricting grooves spaced apart at a predetermined angle from each other along a circumferential direction, the damping clutch unit includes a plurality of restricting projections each of which is insertable into each corresponding constraining groove, and the main gear is disengaged from the damping clutch part as the plurality of restricting projections are dislodged from the plurality of restricting grooves.

8. The door lock apparatus of claim 7, further comprising an elastic member which elastically supports the damping clutch part toward the main gear.

9. The door lock apparatus of claim 7, wherein the shaft includes a clutch engaging portion protruding in a radial direction and the damping clutch part includes a flow groove which is formed in a shape of a circular arc of a predetermined angle and in which the clutch engaging portion is positioned.

10. The door lock apparatus of claim 9, further comprising a knob which is manually operable by a user and is connected to the shaft, wherein when the user rotates the knob, the clutch engaging portion is rotated about a central axis of the shaft within the flow groove.

11. The door lock apparatus of claim 7, wherein the shaft is elastically supported at an interval of 90 degrees in a rotation process.

* * * * *